US008544125B2

(12) United States Patent
Greger et al.

(10) Patent No.: US 8,544,125 B2
(45) Date of Patent: Oct. 1, 2013

(54) CHANGING TABLE CONNECTION TO A PLAYARD

(75) Inventors: Jeff G. Greger, Lititz, PA (US); Michael L. Longenecker, Lancaster, PA (US)

(73) Assignee: Artsana USA, Inc., Lancaster, PA (US)

( * ) Notice: Subject to any disclaimer, the term of this patent is extended or adjusted under 35 U.S.C. 154(b) by 0 days.

(21) Appl. No.: 13/422,075

(22) Filed: Mar. 16, 2012

(65) Prior Publication Data

US 2012/0235103 A1 Sep. 20, 2012

Related U.S. Application Data

(60) Provisional application No. 61/453,501, filed on Mar. 16, 2011.

(51) Int. Cl.
*A47D 13/06* (2006.01)

(52) U.S. Cl.
USPC ..... 5/99.1; 5/93.1; 5/93.2

(58) Field of Classification Search
USPC ..... 5/93.1, 93.2, 655, 99.1, 97, 98.1; 256/23, 25
See application file for complete search history.

(56) References Cited

U.S. PATENT DOCUMENTS

| | | | | |
|---|---|---|---|---|
| 5,918,329 | A | 7/1999 | Huang | |
| 6,173,462 | B1 | 1/2001 | Huang et al. | |
| 6,233,759 | B1 | 5/2001 | Warner, Jr. et al. | |
| 6,543,070 | B2 | 4/2003 | Longenecker et al. | |
| 7,263,729 | B2 | 9/2007 | Paesang et al. | |
| 7,458,114 | B2 * | 12/2008 | Troutman | 5/93.1 |
| 7,581,269 | B2 | 9/2009 | Chen et al. | |
| 7,908,686 | B2 | 3/2011 | Clapper et al. | |
| 8,011,036 | B2 | 9/2011 | Tuckey | |
| 2008/0229982 | A1 | 9/2008 | Miller | |
| 2010/0162484 | A1 | 7/2010 | Thomas et al. | |

* cited by examiner

*Primary Examiner* — Frederick Conley
(74) *Attorney, Agent, or Firm* — Andrew D. Mead

(57) ABSTRACT

A playard having an easily and selectively attachable changing table platform including a saddle structure for resting upon upper perimeter frame members of the playard and secured from unintentional removal by a latching mechanism. The latching mechanism includes a connector that is secured to the playard upper perimeter frame members in a manner fixing the vertical separation of the connector and the frame member. The changing table includes a latching member moveable between catch and release positions that engages the connector as the changing table is moved into an operable position and prevents the changing table from being uplifted from the playard. The moveable latching member is biased toward the catch position. Movement toward the release position allows the changing table to be removed from the playard.

17 Claims, 7 Drawing Sheets

CHANGING TABLE CONNECTION TO A PLAYARD

CROSS-REFERENCE TO RELATED APPLICATIONS

This application claims the benefit of priority of U.S. Provisional Application 61/453,501, filed Mar. 16, 2011.

BACKGROUND OF THE INVENTION

This invention relates generally to a children's playard enclosure, and more particularly to a playard having an easily and selectively attachable changing table platform that, once attached, precludes relative movement between the platform and playard.

Playards are useful to contain and provide a safe environment for small children to sleep or play. Playards generally include side walls and a bottom floor made of fabric material or similar soft goods supported on a collapsible frame that allows the playard to be easily stored or transported. It is known to enhance the usefulness of a playard by installing a bassinet therein to provide an elevated sleeping surface within the side walls and above the bottom floor to provide easy access to the infant without requiring a caregiver to bend to access the playard floor.

It is also known to further enhance the usefulness of a playard by installing an elevated changing platform to position an infant at child at an elevated position for improved caregiver convenience when changing the infant's clothes. A changing table, which is generally rectangular in shape, can be supported on three sides by three upper frame supports of the playard. After the child's clothes have been changed, the changing table can be completely removed from the playard, or, in some embodiments, repositioned to a storage position exterior of the playard.

Connecting a changing table to a playard requires a secure connection therebetween to prevent unintended disconnection while the changing table is in use. Conventionally, the changing table is connected by resting it atop upper frame members of the playard and providing straps or buckles to prevent uplift of the changing table and the resultant unintended disconnection. While providing a secure connection, installing and removing a changing table relying on such connection means is neither simple nor convenient. Significant advantages would be realized by a connection means for attaching a changing table to a playard that optimizes structural integrity and convenience of attachment simultaneously.

It would be convenient to provide an improved connection means for attaching a changing table to a playard that is easily installed and removed and provides a secure connection when installed to prevent unintentional detachment.

SUMMARY OF THE INVENTION

Accordingly, the present invention, in any of the embodiments described herein, may provide one or more of the following advantages:

It is an object of the present invention to provide a means for securely connecting a changing table platform to a playard. The playard frame comprises a plurality of upstanding frame members defining the corners of the playard. A plurality of horizontal frame members individually span between adjacent upstanding frame members to define a top perimeter frame which includes a pair of generally opposing, parallel, and spaced-apart side frame members and a pair of generally opposing end members interconnecting the side frame members. A plurality of generally planar wall panels span between adjacent upstanding frame members to define the side walls of the playard. The changing table connectors comprise a frame connector member connected to the top perimeter frame and a receptacle member connected to the frame connector member. The receptacle member is positioned beneath the frame connector member a pre-determined and fixed distance. Vertical separation between the perimeter frame member and the receptacle member remains fixed as established by the receptacle member itself. The connection further aligns the receptacle member to be generally parallel to the plane of the side wall panels. As the wall panels are typically formed from fabric material, the receptacle member can be attached to the wall panel material in a manner to outwardly expose the receptacle member while keeping the frame connector member concealed within the wall panel material. Connection of the receptacle member to the wall panel secures the receptacle in place axially along the frame member.

The changing table features a pair of saddle connectors configured to rest atop the side frame members of the top perimeter frame. A latch is provided in each saddle connector to engage the receptacle members thereby preventing upward movement of the changing table relative to the top perimeter frame members. Since the receptacle members are fixed in vertical relationship to the perimeter side frame members, the changing table is secured to the playard and vertical movement prevented. The latch also engages the receptacle member such that horizontal movement along the side frame members is also prevented. The latch may include a lever portion for moving the latch into and out of engagement with the receptacle member thereby allowing easy connection and disconnection. A spring biasing member may also be provided to bias the latch in a position to engage the receptacle member It is a still further object of the present invention to provide a connection means for connecting a changing table platform to a playard that is durable in construction, inexpensive of manufacture, carefree of maintenance, easily assembled, and simple and effective to use.

These and other objects are achieved in accordance with the present invention by a playard having an easily and selectively attachable changing table platform that includes a saddle structure for resting upon upper perimeter frame members of the playard and secured from unintentional removal by a latching mechanism. The latching mechanism includes a connector that is secured to the playard upper perimeter frame members in a manner fixing the vertical separation of the connector and the frame member. The changing table includes a latching member moveable between catch and release positions that engages the connector as the changing table is moved into an operable position and prevents the changing table from being uplifted from the playard. The moveable latching member is biased toward the catch position. Movement toward the release position allows the changing table to be removed from the playard.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Many of the fastening, connection, processes and other means and components utilized in this invention are widely known and used in the field of the invention described, and their exact nature or type is not necessary for an understanding and use of the invention by a person skilled in the art, and they will not therefore be discussed in significant detail. Also, any reference herein to the terms "up" or "down," or "top" or "bottom" are used as a matter of mere convenience, and are determined as the playard would normally rest on the floor or a similarly level surface. Furthermore, the various components shown or described herein for any specific application of this invention can be varied or altered as anticipated by this invention and the practice of a specific application of any element may already be widely known or used in the art by persons skilled in the art and each will likewise not therefore be discussed in significant detail. When referring to the figures, like parts are numbered the same in all of the figures.

Figure 1:
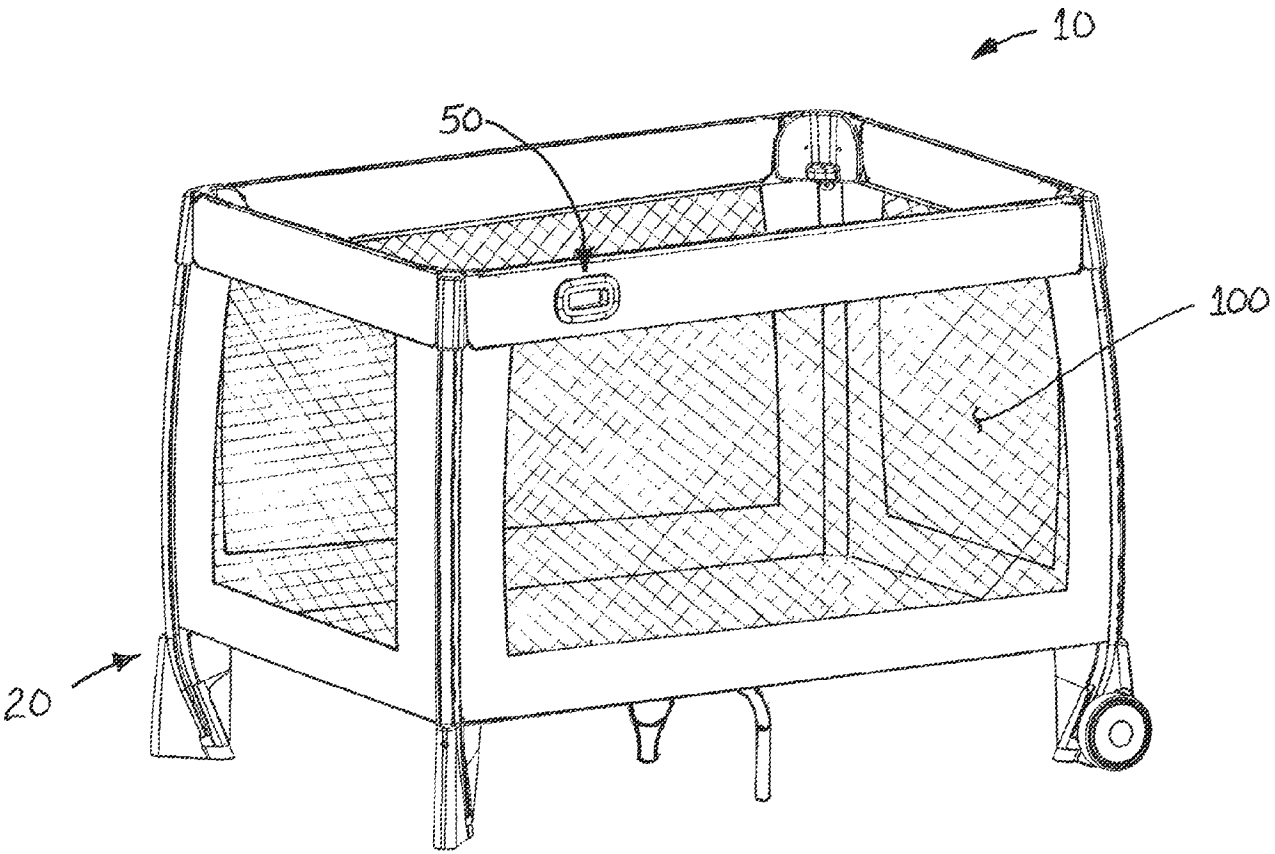
FIG. 1 is a perspective view of a conventional playard on which the present invention is useful.

Referring to the figures, a playard 10 incorporating the principles of the present invention is shown in FIG. 1 comprising an upstanding frame structure 20 covered by a fabric body 100 defining side walls and a floor to contain a small child while leaving the area within the upper perimeter frame open as is conventionally known. For purposes of clarity, the playard and changing table are shown in FIGS. 2 through 8 with soft goods removed to better illustrate the frame members of the respective components.

It is also well known, though not shown in detail, to include movable joints and folding connections that allow the playard frame to be collapsed for portability. For clarity of description of the present invention, the playard frame is shown in an erected position as it would be positioned during use of the invention.

Figure 2:
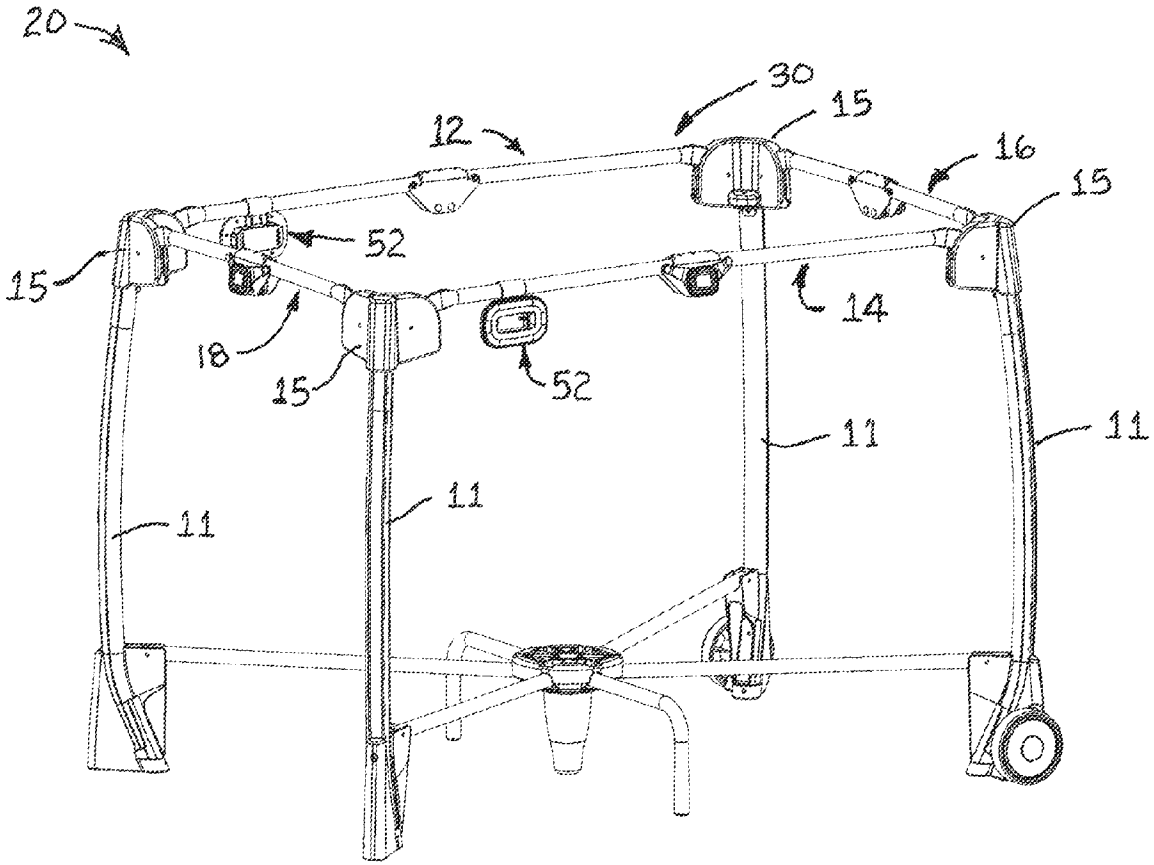
FIG. 2 is a perspective view of a the playard in FIG. 1 in which the soft goods have been removed to shown the playard frame.

In FIG. 2, the playard frame 20 is shown comprising a pair of generally opposing and spaced-apart upper side rail members 12, 14 and a pair of generally opposing upper end rail members 16, 18 disposed between the opposing side rail members to form an upper perimeter frame 30 of the playard frame 20. The upper side rail members 12, 14 typically are connected to the end rail members 16, 18 and other structural members, such as upright legs 11 and corner brackets 15 to establish the playard frame 10 having a generally rectangular upper frame perimeter. It should be noted that the shape and number of corner brackets shown are exemplary only, and other such brackets may also be used to provide the requisite attachment.

Now referring to FIGS. 2 through 6, the exemplary playard frame 20 is shown to further include a selectively attachable changing table frame 80 having a first embodiment of a changing table connector assembly 50. Connector 50 comprises a first or catch portion 52 that is preferably connected to the playard frame, and a latch portion 62 that is preferably connected to the changing platform 80. The connector assembly 50, when operably engaged, secures the changing table platform 80 to the playard frame 20, substantially inhibiting relative movement therebetween and assuring that the changing table platform may not be inadvertently dislodged from its operable position on the playard frame.

Figure 3:
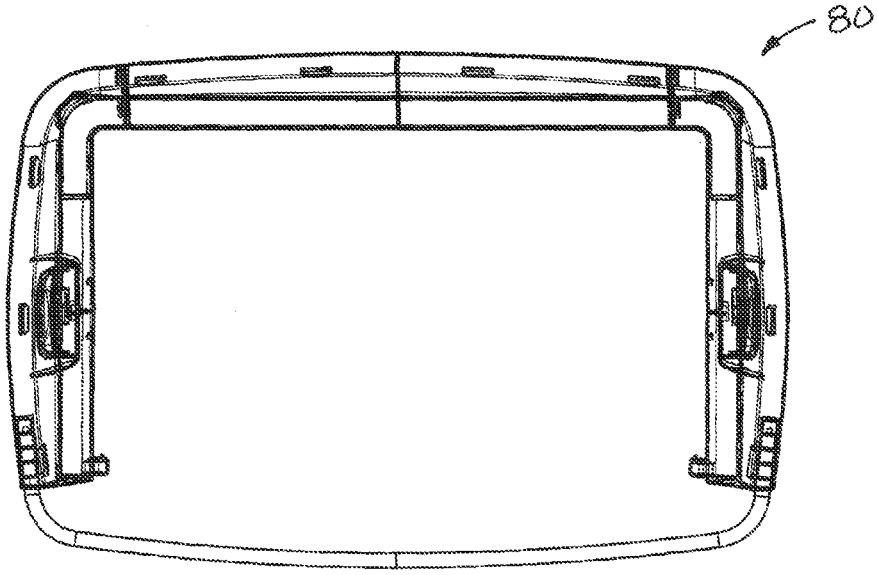
FIG. 3 is a plan view of a changing table platform for use with the playard frame of FIG. 2.
Figure 4:
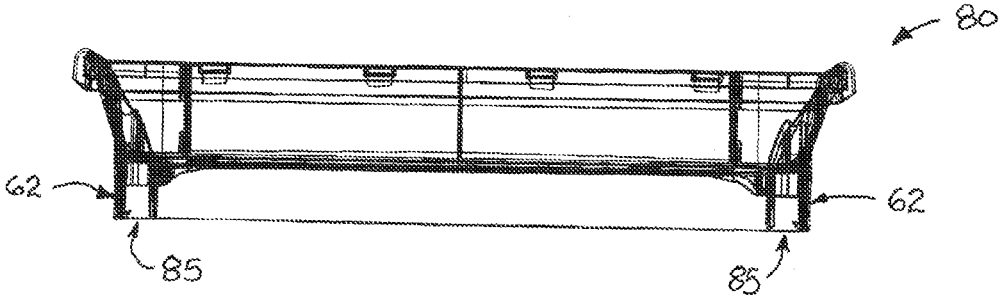
FIG. 4 is a front elevation view of the changing table platform of FIG. 3.
Figure 5:
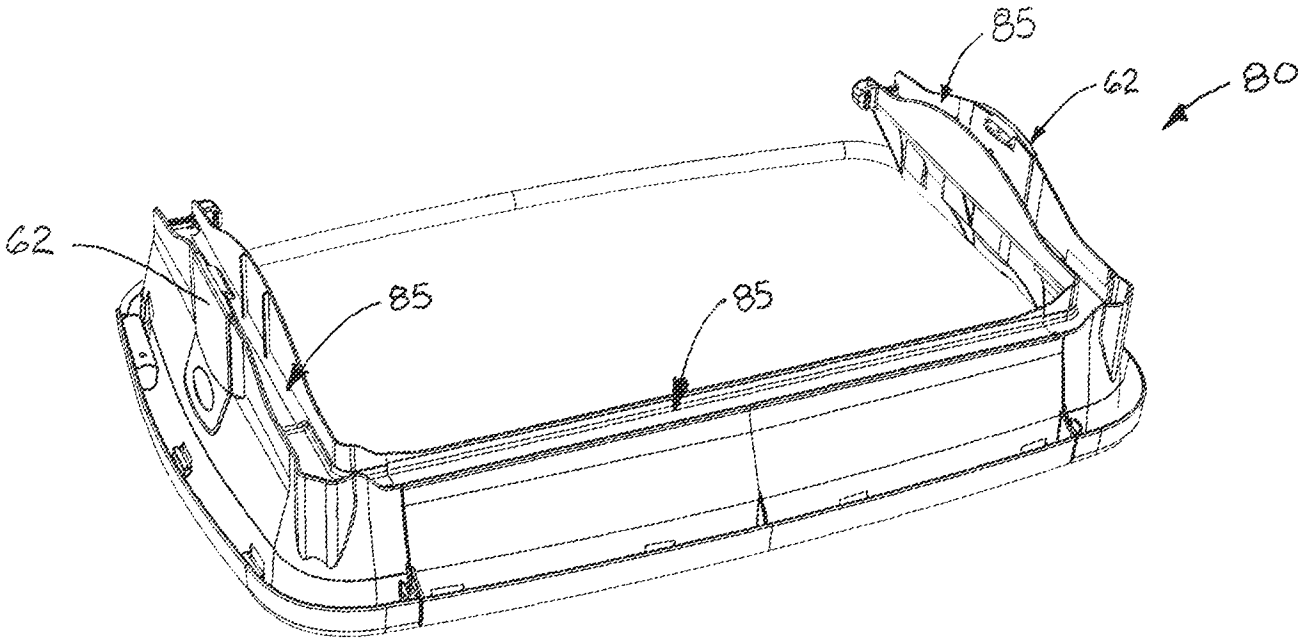
FIG. 5 is a perspective view of the bottom of the changing table platform of FIG. 3 illustrating the support saddle and latch locations.

The exemplary changing table 80 is shown in FIGS. 3 through 5 configured for placement atop the upper perimeter frame 30 of the playard, preferably in a manner to rest upon one of the end rail members 16, 18 and a portion of both side rail members 12, 14. One or more saddle-like receiver structures 85 are provided on the lower edges of the changing table 80 and aligned to engage the playard upper frame members when the changing table is operably installed atop the playard. The receiver structures 85 are configured so that once the changing table is lowered onto the playard frame and the receiver structures 85 engage the upper perimeter frame 30, the changing table is laterally restrained from movement in relation to the playard (see FIG. 6). This engagement also provides vertical support of the changing table 80, precluding further downward movement of the changing table 80 relative to the playard frame 20.

In the embodiment shown, the upper perimeter frame members 12, 14, 16 have generally circular cross-sectional shapes. Cylindrical tubes are preferred for ease of movement when folding the fabric covered playard frame. Other cross-sectional profiles may also be used. The upper perimeter frame members will be covered by soft goods of the playard, increasing the diameter of the frame members over which the receiver structures 85 must fit. The receiver structures 85 are thus sized to accommodate the presence of fabric or similar wall panel material while allowing the changing table to be lowered into a position providing the desired lateral restraint. The receiver structures 85 may also incorporate extended inclined surfaces shaped to guide the changing table into a proper position to engage the rail members as it is lowered onto the upper perimeter frame 30.

Figure 6:
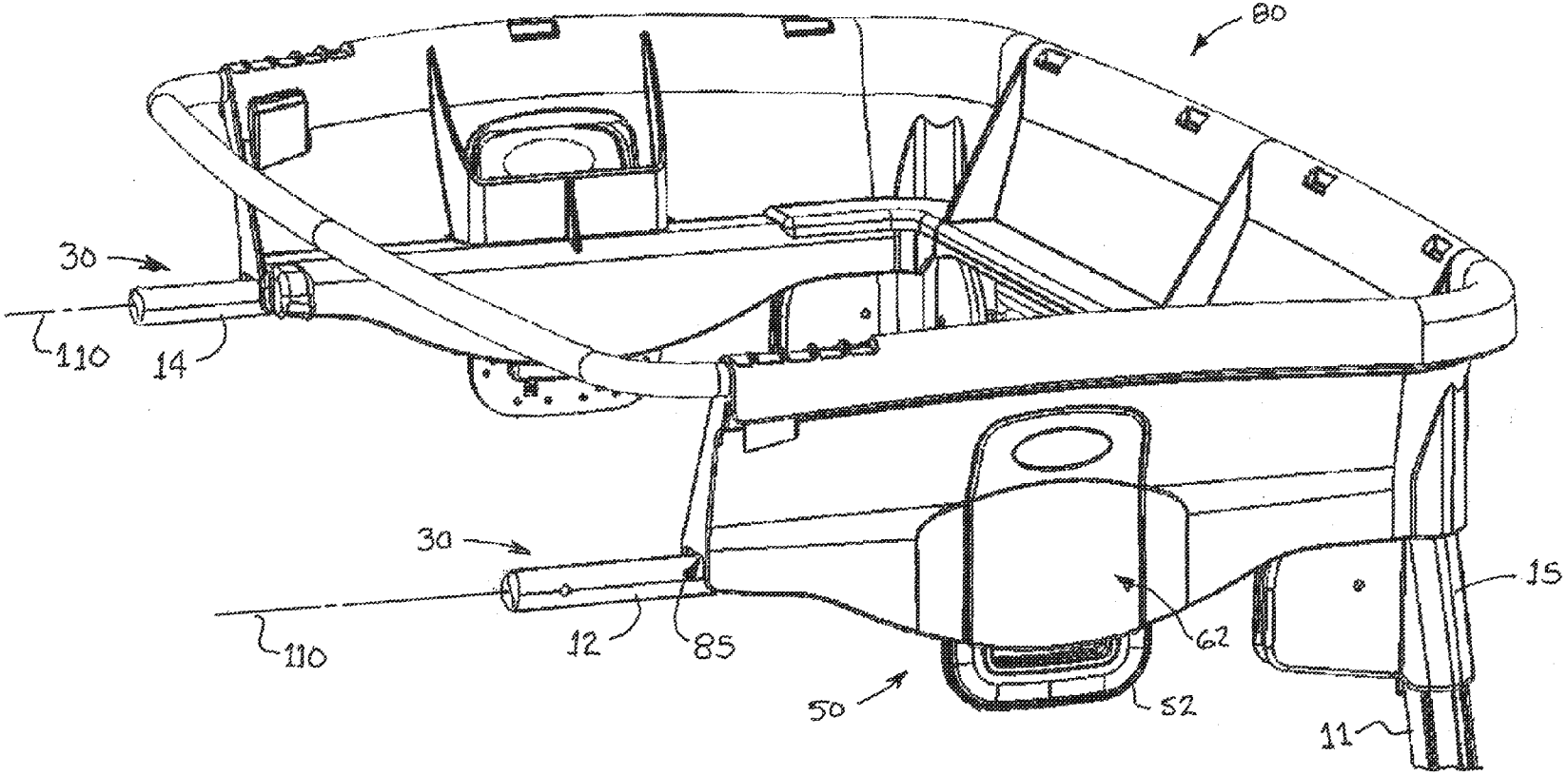
FIG. 6 shows the changing table of FIG. 4 in the operable position with the latching mechanism securing the changing table on the playard frame.
Figure 7:
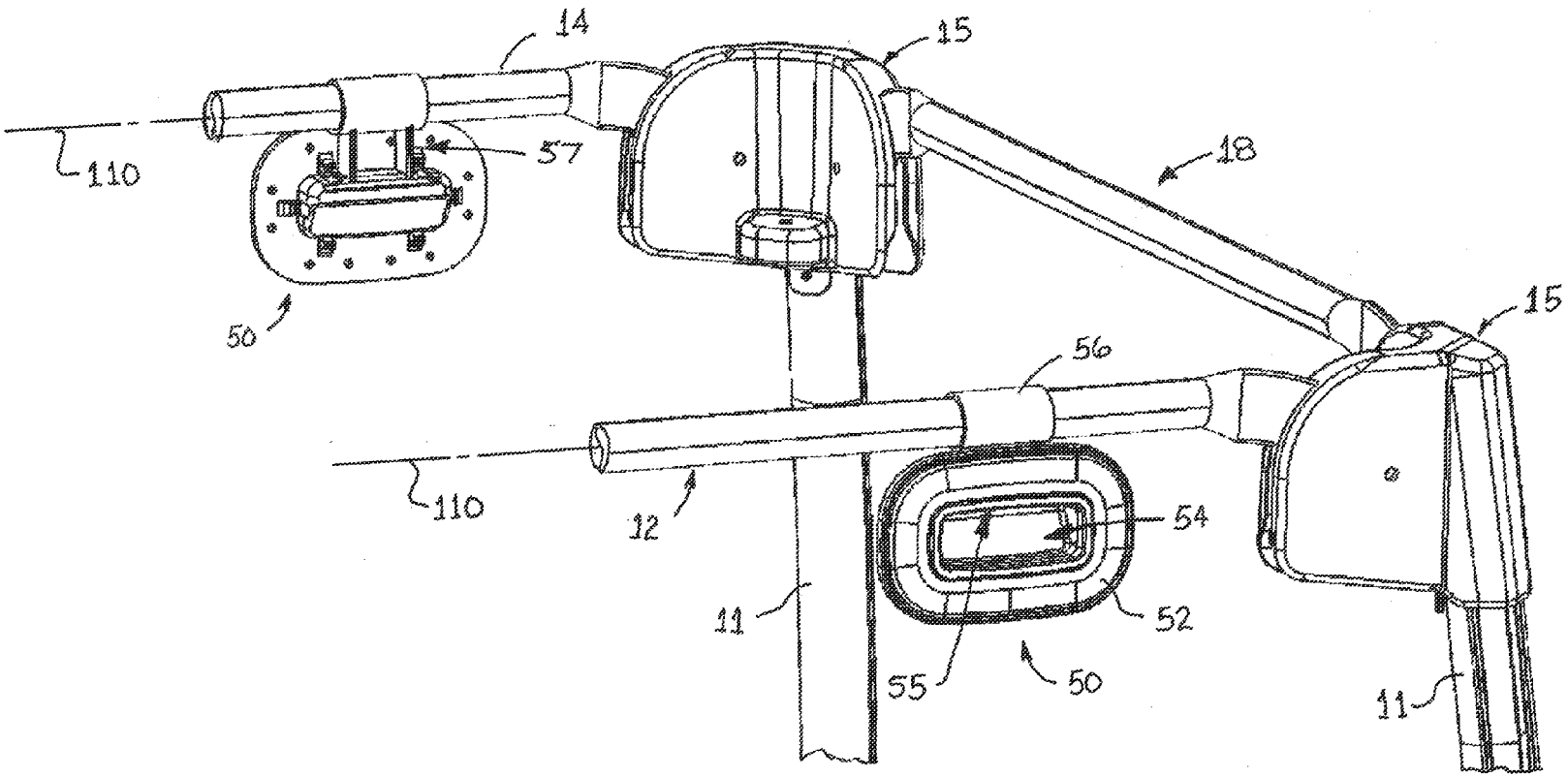
FIG. 7 is an enlarged partial view of the playard frame showing one embodiment of the connector member.
Figure 8:
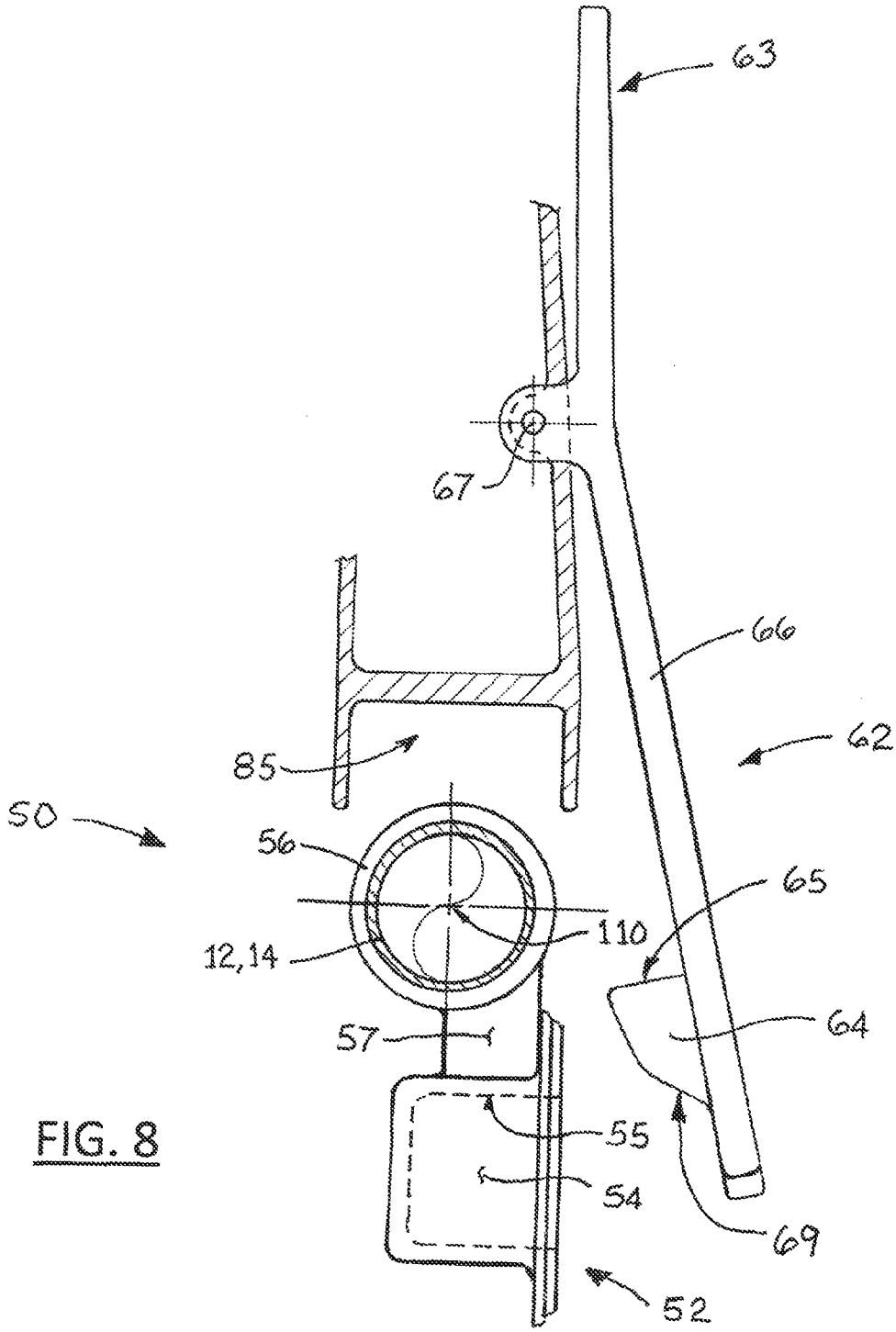
FIG. 8 is a detail view of the changing table latching mechanism illustrating the relationship between the latch and the catch portions.

Returning to the changing table connector assembly 50 and now referring to FIGS. 6 through 8, the connector assembly comprises a catch portion 52 that is preferably connected to the playard frame, and a latch portion 62 that is preferably connected to the changing platform 80. Catch portion 52 includes an outward facing receptacle 54 that is accessible from the exterior of one or more of the playard sides and a catch surface 55 which is oriented generally horizontally and normal to the conventional uplift direction of the changing table 80. The receptacle 54 may include a decorative flange or face to which the fabric material of the wall panels is attached so that the receptacle remains in position with the outer surface of the wall panel fabric material. The catch portion 52 is connected to an upper frame member 12, 14 by a column 57 in a manner that fixes the distance between the frame member 12, 14 and the catch surface 55. A rail connector 56 connects the catch portion 52 via the column 57 to one or more of the frame members 12, 14. The rail connector preferably remains partially free to rotate about the frame member's longitudinal axis 110 and slide axially, this movement being beneficial during folding of the playard and generally controlled by movement of the fabric soft covering during the folding process. Alternate embodiments may incorporate a rotational fixing element, such as a follower on the rail connector engaging a slotted aperture in the tube or a non-symmetrical tube cross section, which limits rail connector movement to axial only along the tube. Radial separation of the catch surface and the frame members remains fixed in all embodiments.

In a preferred embodiment, a connector assembly 50 is provided on opposing ends of the changing table and playard to provide two latching points. Table connector 50 also includes a receptacle 54 for engaging the changing table assembly and a positioning flange 52 outwardly oriented relative to the side wall faces of the playard to facilitate attachment to the material of the side wall panels. The interface between rail connector 56 and the side rail members permits relative movement axially and rotationally, but restrains radial movement. In contrast, a conventional changing table attachment affixes the table connector receptacle to the fabric material of the side panels alone without any structural connector which allows some upward movement of the entire connector receptacle and thus the changing table. The rigid radial restraint provided by the table connector of the present invention eliminates the fabric material from the connection thereby providing a structural connection between the changing table 80 and the playard upper perimeter frame 20.

Table connector assembly 50 also includes one or more latching portions 62 connected to the changing table 80. Each latching portion 62 includes a moveable arm 66 that is pivotally connected to the changing table at pivot joint 67 so that the arm 66 can be moved between an open or released position (shown in FIG. 8) and a closed or engaged position (shown in FIG. 6). A biasing mechanism (not shown), such as a spring, may be provided to bias the movable arm toward the engaged position. Movable arm 66 also includes a retention tab 64 inwardly disposed on the arm 66 featuring a latching surface 65 and an angled guide surface 69. The location of retention tab 64 on movable arm 66 is configured so that the latching surface 65 will be positioned generally in adjacent contact with the catch surface 55 when the changing table 80 is operably positioned with the receiver structures 85 engaging the upper perimeter frame members 12, 14, and the moveable arm is in the engaged position thereby preventing upward movement of changing table 80 relative to the playard frame. It is noted that adjacent contact may not be absolute and that a small gap may exist between the surfaces. Adjacent contact is thus assumed to include adjacent position with up to approximately one-half inch space therebetween to accommodate variations in the compression of soft goods disposed between the frame rails 12, 14 and the receiving structure saddles 85. It is preferred to minimize the gap to minimize relative movement between the changing table and the playard when the changing table is operably connected.

The guide surface 69 on retention tab 64 is provided so that the moveable arm 66 arm will contact the exterior surface of the playard sides and be moved toward the open released position at the changing table is moved downwardly towards its operable position atop the upper frame. As the changing table 80 reaches its operable position, the retention tab 64, and specifically the latching surface will be positioned slightly below the catch surface 55 whereupon the bias force of the spring will cause the moveable arm to pivot inwardly into the engaged position. In this manner, installation of the changing table incorporating the present invention can be accomplished and the uplift latching function will occur without additional actions by a user. The user may release the changing table by depressing the distal end 63 of the moveable arm 66 which pivots the arm outwardly and disengages the latch surface 65 from the catch surface 55.

Naturally, the invention is not limited to the foregoing embodiments, but it can also be modified in many ways without departing from the basic concepts. Changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

We claim:

1. A playard comprising:

an upstanding frame structure having an upper boundary member, a lower floor member, and sides extending therebetween;

a changing platform having a saddle configured to operably support and inhibit lateral movement of said platform upon said upper boundary member and a latching member for securing said saddle to said upstanding frame;

at least one catch member generally co-planarly disposed on one of said sides, said at least one catch member having a catch surface spaced a fixed distance from said upper boundary member;

said latching member being moveable between engaged and released positions, a portion of said latching member engaging said catch surface as said changing platform is moved into an operable position and, once so engaged, preventing uplift of said saddle and changing platform from said playard.

2. The playard of claim 1, wherein said latching member further includes a spring member to bias said latching member toward said engaged position.

3. The playard of claim 2, wherein movement of said latching member toward said released position disengages said portion of said latching member from said catch surface thereby permitting uplift of said platform from said playard.

4. The playard of claim 3, wherein said portion of said latching member is configured to interact with said sides and move said latching member away from said engaged position as said changing platform is moved toward said operable position and said spring member moves said latching member into said engaged position when said changing platform reaches said operable position.

5. The playard of claim 4, wherein said latching member further includes a releasing lever configured to selectively move said latching member away from said engaged position.

6. The playard of claim 5, wherein said playard further includes a pair of spaced apart and generally parallel sides bounded at a top edge by a respective said upper boundary member, said changing platform further includes generally opposing ends each having a saddle configured to be supported upon said upper boundary member of respective sides, and at least one latching member on each said opposing ends.

7. The playard of claim 6, wherein said upper boundary further includes at least one longitudinal axis and connection of said at least one catch member connection to said upper boundary member prevents rotational movement of said at least one catch member about said longitudinal axis and maintains said catch surface a fixed distance from said upper boundary member longitudinal axis.

8. A playard comprising:

an upstanding frame structure having an upper boundary member, a lower floor member, and sides extending therebetween;

a changing platform having a saddle configured to engage said upper boundary member to operably support said platform upon said upper boundary member while inhibiting relative lateral movement;

at least one latching member pivotally connected to said saddle along a generally horizontal pivot axis, said at least one latching member having a latch surface spaced a fixed distance from said pivot axis and moveable between opposing engaged and released positions; and at least one latch connector attached to said upper boundary member, said at least one latch connector having a catch surface spaced a fixed distance from said upper boundary member, said at least one latching member generally fixing said saddle to said upstanding frame when said changing platform is operably positioned and said latching member is engaged so that said latch surface and said catch surface are positioned in adjacent contact, said at least one latching member allows said saddle to be upwardly displaced from said upstanding frame when said latching member is released.

9. The playard of claim 8, wherein movement of said latching member toward said released position moves said latch surface and said catch surface toward a non-adjacent position thereby allowing uplift of said platform relative to said playard.

10. The playard of claim 9, wherein said latching member further includes a spring member to bias said latching member toward said engaged position.

11. The playard of claim 10, wherein said latching member is configured to interact with said sides and move said latch surface away from said engaged position as said changing platform is moved toward said operable position and said spring member moves said latching member into said engaged position when said changing platform reaches said operable position.

12. The playard of claim 11, wherein said latching member further includes a releasing lever configured to selectively move said latching member away from said engaged position.

13. The playard of claim 12, wherein said playard further includes a pair of spaced apart and generally parallel sides bounded at a top edge by a respective said upper boundary member, said changing platform further includes generally opposing ends each having a saddle configured to be supported upon said upper boundary member of respective sides, and at least one latching member on each said opposing ends.

14. The playard of claim 13, wherein each said upper boundary further comprises at least an elongate, generally rigid frame member having a longitudinal axis, and said at least one catch member connection to said upper boundary member allows rotational movement of said at least one catch member about said longitudinal axis, allows axial movement along said longitudinal axis, and maintains said catch surface a fixed distance from said longitudinal axis.

15. The playard of claim 13, wherein each said upper boundary further comprises at least an elongate, generally rigid frame member having a longitudinal axis, and said at least one catch member connection to said upper boundary member allows axial movement along said longitudinal axis, prevents rotational movement of said at least one catch member about said longitudinal axis, and maintains said catch surface a fixed distance from said longitudinal axis.

16. A playard comprising:

an upstanding frame structure having an upper boundary member extending along a longitudinal axis, a lower floor member, and sides extending therebetween bounded at a top edge by a respective said upper boundary member;

a changing platform having generally opposing ends each having a saddle configured to be supported upon said upper boundary member of respective sides while inhibiting relative lateral movement, and at least one latching member on each said opposing ends;

at least one latching member pivotally connected to said saddle along a generally horizontal pivot axis, said at least one latching member having a latch surface spaced a fixed distance from said pivot axis and moveable between opposing engaged and released positions, said at least one latching member having a spring member to bias said at least one latching member toward said engaged position and a releasing lever for selectively moving said latch member toward said released position, said latching member configured to interact with said sides to move said latching member toward said released position as said changing platform is moved toward said operable position; and at least one latch connector attached to said upper boundary member in a manner allowing rotational movement about said longitudinal axis and axial movement along said longitudinal axis, said at least one latch connector having a catch surface spaced a fixed distance from said upper boundary member, said at least one latching member generally fixing said saddle to said upstanding frame when said changing platform is operably positioned and said latching member is engaged so that said latch surface and said catch surface are positioned in adjacent contact, said at least one latching member allows said saddle to be upwardly displaced from said upstanding frame when said latching member is released.

17. The playard of claim 16, wherein said at least one catch member connection to said upper boundary member prevents rotational movement of said at least one catch member about said longitudinal axis.

* * * * *